US006758232B2

(12) United States Patent
Higuchi

(10) Patent No.: US 6,758,232 B2
(45) Date of Patent: Jul. 6, 2004

(54) STEAM PRESSURE REDUCING AND CONDITIONING SYSTEM

(75) Inventor: Hiroyuki Higuchi, Kashiwazaki (JP)

(73) Assignee: Dresser, Inc., Addison, TX (US)

( * ) Notice: Subject to any disclaimer, the term of this patent is extended or adjusted under 35 U.S.C. 154(b) by 123 days.

(21) Appl. No.: 10/039,343

(22) Filed: Jan. 4, 2002

(65) Prior Publication Data

US 2002/0092483 A1 Jul. 18, 2002

(51) Int. Cl.[7] ..... B01D 47/00
(52) U.S. Cl. ..... 137/3; 137/605
(58) Field of Search ..... 137/605, 606, 137/607, 3

(56) References Cited

U.S. PATENT DOCUMENTS

| | | | | |
|---|---|---|---|---|
| 1,152,176 | A | 8/1915 | Hennebohle | |
| 1,307,986 | A | 6/1919 | Randall et al. | |
| 1,832,652 | A | 11/1931 | Peebles | |
| 2,095,263 | A | 10/1937 | Moss | 251/11 |
| 2,207,646 | A | 7/1940 | Van Der Ploeg | 122/459 |
| 2,354,842 | A | 8/1944 | Spence | 261/116 |
| 2,421,761 | A | 6/1947 | Rowand et al. | |
| 2,924,424 | A | 2/1960 | Titterington | 251/305 |
| 2,984,468 | A | 5/1961 | Kuhner | 261/79 |
| 3,034,771 | A | 5/1962 | Harris | 261/36 |
| 3,050,262 | A | 8/1962 | Curtis | 239/400 |
| 3,207,492 | A | 9/1965 | Zikesch | |
| 3,219,323 | A | 11/1965 | Spence | |
| 3,220,708 | A | 11/1965 | Matsui | 261/39 |
| 3,318,321 | A | 5/1967 | Odendahl | 137/117 |
| 3,331,590 | A | 7/1967 | Battenfeld et al. | 261/50 |
| 3,496,724 | A | 2/1970 | Wilson | 60/105 |
| 3,648,714 | A | 3/1972 | Laveau | 137/7 |
| 3,709,245 | A | 1/1973 | O'Connor, Jr. | 251/127 |
| 3,719,524 | A | 3/1973 | Ripley et al. | |
| 3,722,854 | A | 3/1973 | Parola | 251/127 |
| 3,732,851 | A | 5/1973 | Self | |
| 3,735,778 | A | 5/1973 | Garnier | 137/604 |
| 3,746,049 | A | 7/1973 | O'Connor, Jr. | 137/802 |
| 3,750,698 | A | 8/1973 | Walchle et al. | 137/375 |
| 3,776,278 | A | 12/1973 | Allen | 137/625.38 |
| 3,813,079 | A | 5/1974 | Baumann et al. | 251/127 |
| 3,856,049 | A | 12/1974 | Scull | 138/42 |

(List continued on next page.)

FOREIGN PATENT DOCUMENTS

| | | |
|---|---|---|
| DE | 37 17 128 A1 | 12/1988 |
| DE | 298 01 762 U1 | 4/1998 |
| FR | 595499 | 10/1925 |
| FR | 2082083 | 11/1971 |
| GB | 772058 | 4/1957 |
| GB | 2019532 | 10/1979 |
| JP | 61153082 | 7/1986 |
| WO | WO 91/00971 | 1/1991 |
| WO | WO 97 03313 | 1/1997 |

OTHER PUBLICATIONS

European Patent Office Search Report signed by Examiner Girbes Fontana, completed Sep. 8, 2003.

(List continued on next page.)

*Primary Examiner*—Stephen M. Hepperle
(74) *Attorney, Agent, or Firm*—Fish & Richardson P.C.

(57) ABSTRACT

A steam conditioning system including a steam conditioning valve 1 for depressurizing and desuperheating steam S by supplying moisture W in the conditioning valve. A discharge pipe 3 connected to the steam conditioning valve 1 has a horizontal section 3*a*, and the horizontal arrangement section 3*a* is provided with a moisture drain 4 or at a portion near the bottom. Condensed moisture $W_1$ is extracted from this moisture drain 4 and is recycled as moisture W to be supplied to the steam S in the conditioning valve 1. The steam conditioning valve 1 further has a reduced annular section 9 with a nozzle 5*a* disposed therein for injecting subcooled water mist W. A transport conduit 5 connects the drain 4 to nozzle 5*a*. Moisture W is drawn into steam flow S due to the Venturi effect caused by the pressure drop through the reduced annular section 9.

20 Claims, 3 Drawing Sheets

U.S. PATENT DOCUMENTS

| | | | | |
|---|---|---|---|---|
| 3,904,722 | A | | 9/1975 | Onodo et al. |
| 3,931,371 | A | | 1/1976 | Maurer et al. |
| 3,941,350 | A | | 3/1976 | Kluczynski | 251/127 |
| 3,978,891 | A | | 9/1976 | Vick | 138/42 |
| 3,981,946 | A | | 9/1976 | Soya et al. |
| 3,990,475 | A | | 11/1976 | Myers | 137/625.3 |
| 4,011,287 | A | | 3/1977 | Markey |
| 4,022,423 | A | | 5/1977 | O'Connor et al. | 251/127 |
| 4,068,683 | A | | 1/1978 | Self | 137/625.3 |
| RE29,714 | E | | 8/1978 | Hayner et al. | 138/42 |
| 4,105,048 | A | | 8/1978 | Self | 138/42 |
| 4,128,109 | A | | 12/1978 | Chervenak et al. | 137/375 |
| 4,149,563 | A | | 4/1979 | Seger | 137/625.3 |
| 4,243,203 | A | | 1/1981 | Mack | 251/305 |
| 4,249,574 | A | | 2/1981 | Schnall et al. | 137/625.3 |
| 4,267,045 | A | | 5/1981 | Hoof | 210/322 |
| 4,270,559 | A | | 6/1981 | Wallberg | 137/15 |
| 4,278,619 | A | | 7/1981 | Tiefenthaler |
| 4,279,274 | A | | 7/1981 | Seger | 138/42 |
| 4,352,373 | A | | 10/1982 | Kay et al. | 137/561 |
| 4,383,553 | A | | 5/1983 | Platt | 138/46 |
| 4,387,732 | A | | 6/1983 | Hetz | 137/183 |
| 4,397,331 | A | | 8/1983 | Medlar | 137/375 |
| 4,407,327 | A | | 10/1983 | Hanson et al. | 137/625 |
| 4,413,646 | A | | 11/1983 | Platt et al. | 137/240 |
| 4,427,030 | A | | 1/1984 | Jouwsma | 138/42 |
| 4,442,047 | A | | 4/1984 | Johnson |
| 4,505,865 | A | | 3/1985 | Wiillenkord | 261/44 |
| 4,567,915 | A | | 2/1986 | Bates et al. | 138/42 |
| 4,593,446 | A | | 6/1986 | Hayner | 29/157 |
| RE32,197 | E | | 7/1986 | Self | 251/127 |
| 4,619,436 | A | | 10/1986 | Bonzer et al. | 251/61.1 |
| 4,624,442 | A | | 11/1986 | Duffy et al. | 251/61.1 |
| 4,671,321 | A | | 6/1987 | Paetzel et al. | 137/625.3 |
| 4,688,472 | A | | 8/1987 | Inglis | 98/1 |
| 4,718,456 | A | | 1/1988 | Schoonover | 137/625.37 |
| 4,739,795 | A | | 4/1988 | Ewbank et al. | 137/625.38 |
| 4,887,431 | A | | 12/1989 | Peet | 60/667 |
| 4,909,445 | A | | 3/1990 | Schoonover |
| 4,941,502 | A | | 7/1990 | Loos et al. | 137/116 |
| 4,967,998 | A | | 11/1990 | Donahue | 251/121 |
| 5,005,605 | A | * | 4/1991 | Kueffer et al. | 137/625.39 |
| 5,012,841 | A | * | 5/1991 | Kueffer | 137/625.39 |
| 5,156,680 | A | | 10/1992 | Orzechowski | 118/46 |
| 5,336,451 | A | | 8/1994 | Lovick |
| 5,380,470 | A | | 1/1995 | Jacobsson |
| 5,385,121 | A | | 1/1995 | Feiss et al. |
| 5,390,896 | A | | 2/1995 | Smirl | 251/127 |
| 5,427,147 | A | | 6/1995 | Henriksson | 137/625.3 |
| 5,672,821 | A | | 9/1997 | Suzuki | 73/202 |
| 5,730,416 | A | | 3/1998 | Welker | 251/118 |
| 5,762,102 | A | | 6/1998 | Rimboym | 137/492.5 |
| 5,765,814 | A | | 6/1998 | Dvorak et al. | 251/127 |
| 5,769,388 | A | | 6/1998 | Welker | 251/118 |
| 5,819,803 | A | | 10/1998 | Lebo et al. | 138/42 |
| 5,924,673 | A | | 7/1999 | Welker | 251/118 |
| 5,931,445 | A | | 8/1999 | Dvorak et al. | 251/118 |
| 6,003,551 | A | | 12/1999 | Wears | 137/625.33 |
| 6,105,614 | A | | 8/2000 | Bohaychuk et al. | 137/625.3 |
| 6,250,330 | B1 | | 6/2001 | Welker | 137/489 |
| 6,289,934 | B1 | | 9/2001 | Welker | 138/39 |
| 2002/0096052 | A1 | | 7/2002 | Higuchi |

OTHER PUBLICATIONS

European Search report for Application 02007252 dated Apr. 3, 2003.

Product Brochure titled "Masonelian Steam Form II" printed Oct. 12, 2001 and distributed at Power Generation Show held in Las Vegas, Nevada on Dec. 11–13, 2001 and at a Power Generation Show in Milan, Italy Jun. 11–13, 2002.

Stares, Gober and Robert; "4100 Series Control Valves"; Masoneilan; May 1997; 6 pages.

SteamForm Conditioning Valves, Yarway Tyco Corporation 1981.

Copes–Vulcon; SA–35 Steam Atomizing Desuperheater, White; Consolidated Industries, Bulletin 1164; May 01; 5 pages.

* cited by examiner

Prior Art

STEAM PRESSURE REDUCING AND CONDITIONING SYSTEM

TECHNICAL FIELD OF THE INVENTION

The present invention concerns a steam pressure reducing and conditioning system.

RELATED APPLICATION

The present invention includes common subject matter disclosed in U.S. application Ser. No. 10/038,985, entitled Steam Pressure Reducing and Conditioning Valve by the same inventor Hiroyuki Higuchi filed concurrently on Jan. 04, 2002, the disclosure of which is incorporated herein by reference.

BACKGROUND OF THE INVENTION

Referring to Prior Art FIG. 3, it has been known to have a steam pressure reducing and conditioning system comprising a steam source 24 (such as boiler) for generating superheated steam S, a pressure reducing and conditioning valve 21 for depressurizing and desuperheating steam S generated by this steam source 24, and a discharge pipe 23 connected to an outlet of steam pressure reducing and conditioning valve 21, and connected to a steam work section 22, downstream of valve 21.

As illustrated in Prior Art FIG. 3, steam pressure and conditioning valve 21 receives superheated and pressurized steam S inflowing in inlet 21*a*. Steam S is desuperheated and depressurized by passing steam S valve 21 and injecting subcooled water mist W (not shown) from one or more nozzles 25 in the lower portion of valve 21.

The desuperheated and depressurized steam $S_1$, discharged from the valve 21 and the subcooled water mist W injected in valve 21, flow into the discharge pipe 23 and are conveyed to the steam work section 22. A portion of discharge pipe 23 is arranged horizontally 23*a*. Some of the subcooled water mist W condenses and clings to the discharge pipe at 23*a* and flows along the bottom of the horizontal section. Steam $S_1$ flows past these areas of condensation creating temperature differentials in the interior surface of the pipe 23.

Consequently, the pipe 23 deforms (bends upward) and possibly breaks due to expansion and stress due to the temperature difference in horizontal section of pipe 23, and moreover, the condensed moisture $W_1$, flowing at the bottom of the pipe 23 is enrolled up by the high speed flow of steam $S_1$ (jumping phenomenon). The jumping phenomenon erroneous temperature measurements in temperature sensors in the pipe 23 for detecting the heat of the steam $S_1$.

It is an object of the present invention to provide a steam pressure reducing and conditioning system that can solve the aforementioned problems.

BRIEF DESCRIPTION OF THE DRAWINGS

The disclosed invention will be described with reference to the accompanying drawings, which show important sample embodiments of the invention and which are incorporated in the specification hereof by reference. A more complete understanding of the present invention may be had by reference to the following Detailed Description when taken in conjunction with the accompanying drawings, wherein.

SUMMARY OF THE INVENTION

Figure 1:
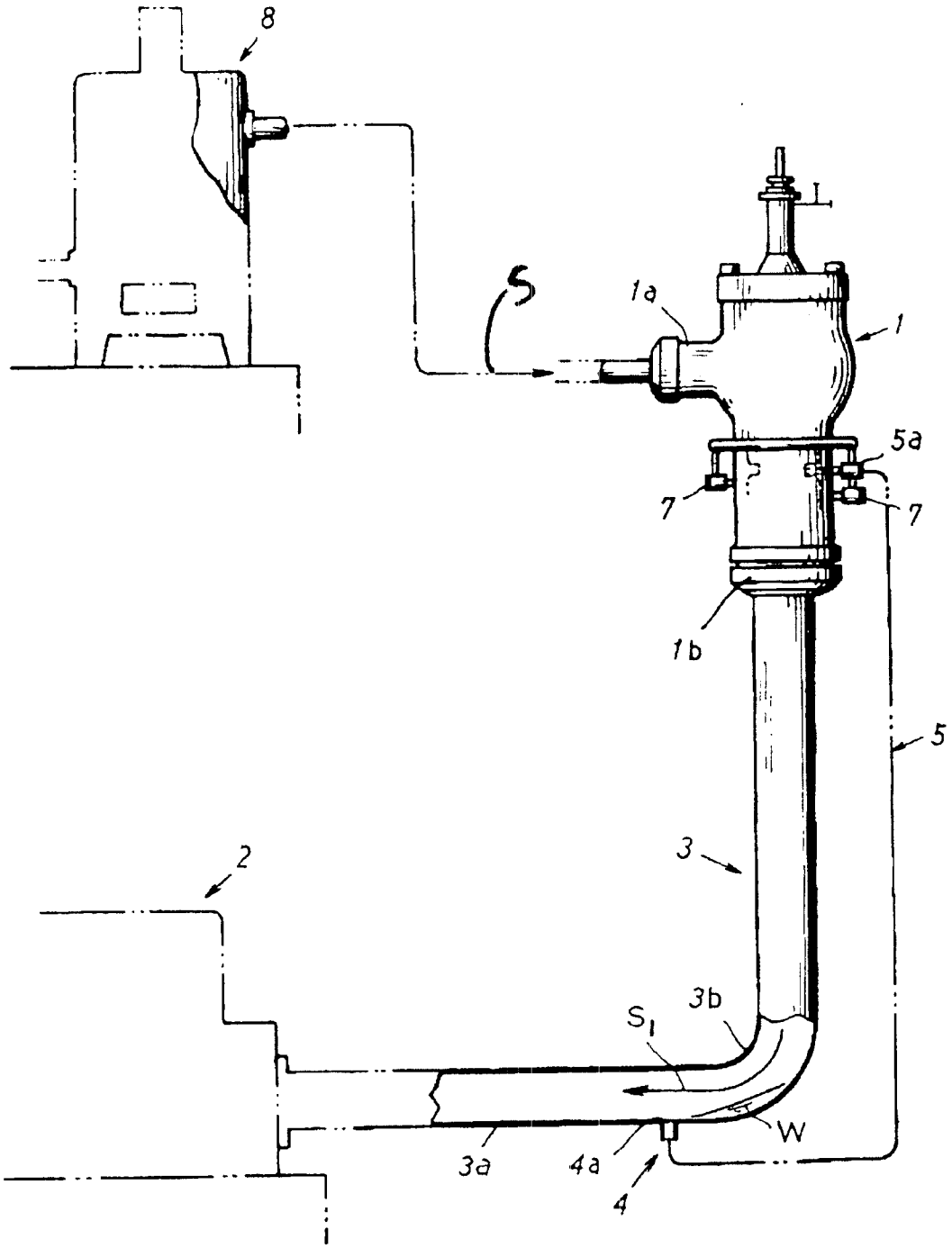
FIG. 1 is a partial side view with schematic elements illustrating the operation of the steam pressure reducing and conditioning system of the present invention.

Reference is now made to the Drawings wherein like reference characters denote like or similar parts throughout the Figures.

The present invention concerns a steam pressure reducing and conditioning system comprising a steam reducing and conditioning valve 1 for desuperheating and depressurizing superheated steam S by injecting subcooled water mist W in the lower portion of valve 1. A discharge pipe 3 is connected at its proximal end to the exit of valve 1. A steam work section 2 is connected at the distal end of pipe 3. The discharge pipe 3 has a horizontal portion 3*a*, and said horizontal portion 3*a* is provided with a moisture drain 4 at the bottom portion or at a portion near the bottom of the horizontal portion 3*a* of pipe 3. Condensed subcooled water mist ("moisture") $W_1$ is extracted from discharge pipe 23 by drain 4 and is recycled and reinjected as moisture W to be supplied to the vapor S in said conditioning valve 1. Moisture drain 4 is connected by a moisture transport conduit 5 to the conditioning valve 1.

The steam conditioning valve 1 further includes a reduced annular section 9 with a nozzle 5*a* disposed therein for injecting subcooled water mist W into the reduced annular section 9 of conditioning valve 1. Moisture W is drawn into steam flow S due to the Venturi effect caused by the pressure drop through the reduced annular section.

Method of Operation

A superheated steam S is desuperheated by supplying subcooled water mist ("moisture") W to steam conditioning valve 1. The desuperheated steam $S_1$ flowing out from the conditioning valve 1 and the moisture W used for cooling in discharge valve 1 flows into discharge pipe 3, and is introduced in the steam work section 2 connected to the downstream area of the discharge pipe 3.

In the present invention, when the moisture W discharged from the conditioning valve 1 flows through the horizontal section 3*a* of the discharge pipe 3, the condensed moisture $W_1$ is drained from a moisture drain 4 disposed at the bottom portion 3*a* of this pipe 3, and the moisture $W_1$ extracted from the moisture drain 4 is recycled as part of moisture W to be supplied to the steam S in the steam conditioning valve 1.

Consequently, moisture $W_1$ can be removed from the horizontal section 3*a* of the pipe 3, preventing the moisture $W_1$ from stagnating at the bottom of the pipe, solving the aforementioned problem of the prior art discussed in the background section, and further, the recycling of moisture $W_1$ used for cooling the vapor S again in the conditioning valve 1 saves energy.

DETAILED DESCRIPTION

The attached drawings show an embodiment of the present invention, which will be described below.

Figure 2:
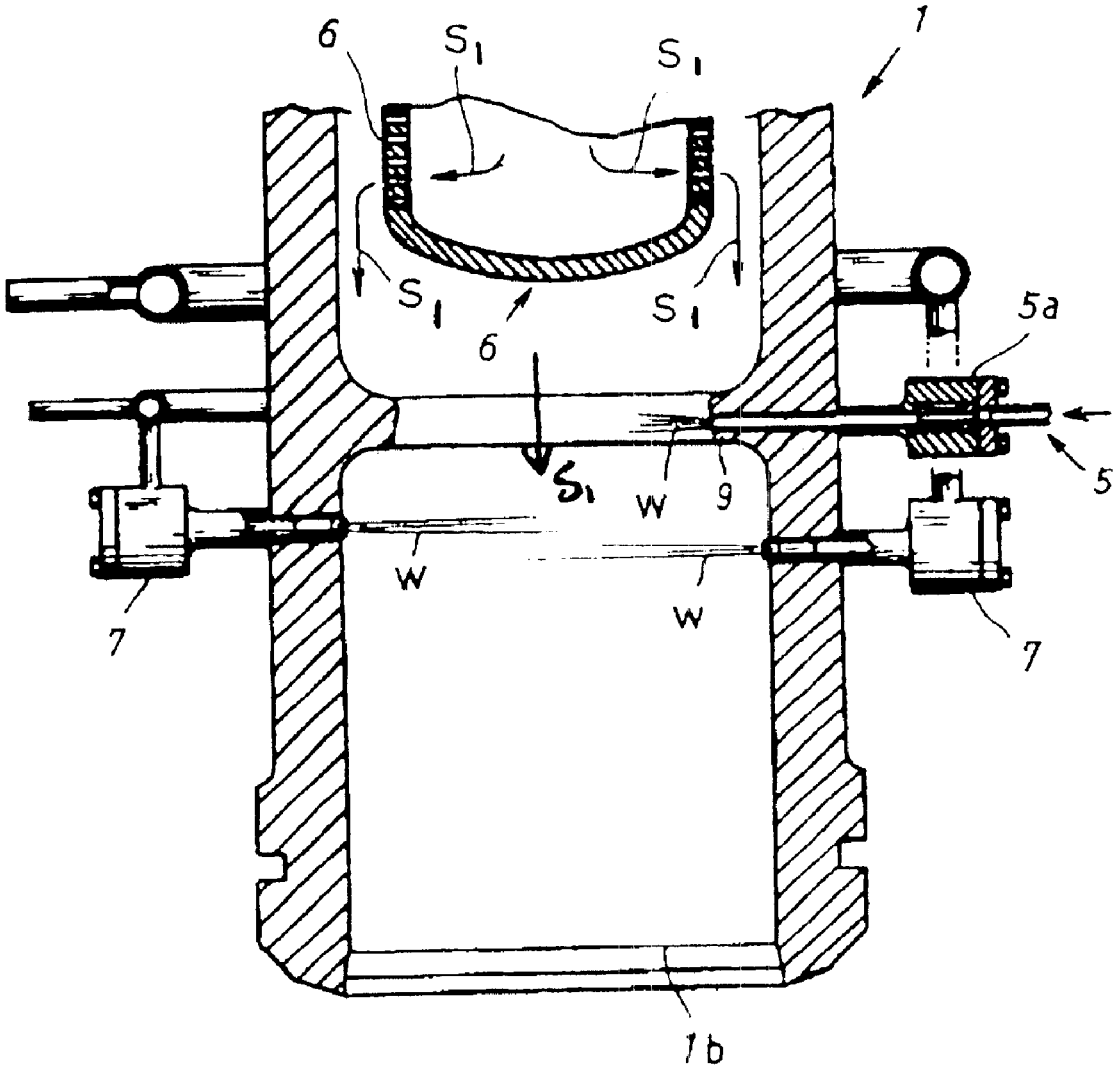
FIG. 2 is a partial cross-section view illustrating a portion of the pressure reducing and conditioning valve used in the system of the present invention of FIG. 1.

This embodiment of the present invention comprises, as shown in FIGS. 1 and 2, a steam desuperheating and conditioning valve 1 wherein a superheated and pressurized steam S generated in a steam generation source 8 (for instance, boiler) flows into a first port 1*a* of conditioning valve 1. Steam S is desuperheated and depressurized by passing through a small hole section 6 (diffuser) having scattered small holes 6*a*, and the steam $S_1$ is discharged from a second port 1*b* of conditioning valve 1. Steam $S_1$ is desuperheated by injecting a subcooled water mist "moisture" W from one or more nozzles 7. A discharge pipe 3 is connected at its proximal end to the exit of conditioning valve 1, and at its distal end to a steam work section 2 (for instance, condenser for a nuclear reactor).

Also, in this embodiment, the discharge pipe 3 is provided with a horizontal section 3*a* extending from the conditioning valve 1 and disposed horizontally with an elbow section 3*b* (bent section). The discharge pipe 3 is so composed that the condensed moisture $W_1$ flowing in this horizontal section 3*a* is part of the moisture W to be supplied to the vapor S in the conditioning valve 1.

To be more specific, as shown in FIG. 1, said discharge pipe 3 is provided with a moisture drain 4 having a drain hole 4*a* at or near the bottom portion of the horizontal section 3*a*, said moisture drain 4 is provided with a moisture transport conduit 5 for conveying moisture $W_1$ extracted from the moisture drain 4 to the vapor cooler 1.

This moisture transport conduit 5 is a tubular element having a predetermined diameter, and connected to a reduced annular area 9 constituting a predetermined area of the conditioning valve 1, where a steam $S_1$ flowing in the conduit will flow faster than the steam flowing in the larger diameter discharge pipe 3.

Referring to FIG. 2, an annular reduced diameter section 9 is disposed in the lower portion of conditioning valve 1 at a position near the jet nozzle 7 of the conditioning valve 1. A nozzle 5*a* of the moisture conduit 5 exits into this reduced diameter section 9, and it is so configured that the moisture $W_1$ in the moisture conduit 5 is injected into depressurized steam $S_1$ path, in this reduced diameter section 9.

This reduced diameter section 9 obtains improved cooling effect by maintaining the steam $S_1$ flow rate immediately passing through the reduced diameter section 9 faster than the vapor $S_1$ passing through the discharge pipe 3, thereby reducing the pressure at the position of the reduced diameter section 9 below the pressure in the discharge pipe 3. This pressure drop in a reduced diameter section 9 is due to the increased velocity of a constant flow volume. Such an effect is well known in the art and is referred to as a Venturi effect. Consequently, this embodiment of the present invention allows return of the moisture $W_1$ from the discharge pipe 3 to the conditioning valve 1 by connecting the nozzle 5*a* of moisture transport conduit 5 to this reduced diameter section 9, and drawing the moisture $W_1$ from the nozzle 5*a* into the conditioning valve 1 using the differential pressure generated by the Venturi negative pressure phenomenon.

Considering the optimal conditions for the circulation method using this differential pressure, it is preferable to set this level difference to 10 meters or less, in the case where the moisture drain 4 is placed lower than the nozzle 5*a* (no limitation in the case where the moisture drain section 4 is placed higher than the nozzle 5*a*).

In this embodiment, the vapor $S_1$ differential pressure is used as mentioned before, as a means for recycling the moisture $W_1$ flowing from the conditioning valve 1 back to the conditioning valve 1. The system also permits connecting the moisture transport conduit 5 to a desired position of the conditioning valve 1 by disposing a forced delivery apparatus (for instance a pump or the like), in the middle section of the moisture transport conduit 5.

Composed as described above, this embodiment desuperheats the steam S in the conditioning valve 1, and the desuperheated and depressurized steam $S_1$ is discharged from the conditioning valve 1 together with moisture W into the discharge pipe 3. The steam $S_1$ flowing through discharge pipe 3 is introduced into the steam work section 2 connected to the distal end of the discharge pipe 3. The moisture $W_1$ flowing at the bottom of the discharge pipe 3 is extracted by the moisture drain 4, transferred by the moisture transport conduit 5 and recycled as moisture W for cooling in the steam conditioning valve 1.

Therefore, this embodiment provides for an energy efficient removal of the moisture $W_1$ from the horizontal section 3*a* of the discharge pipe 3, thereby preventing the moisture $W_1$ from stagnating at the bottom of the discharge pipe 3, avoiding as much as possible the pipe 3 deformation (damage) and the detrimental effect to the temperature detection sensor and other problems of the prior art. Additionally, the present invention provides for recycling the moisture $W_1$ used for cooling the vapor $S_1$ in the conditioning valve 1 providing for energy efficient cooling.

I claim:

1. A steam conditioning system having:

a steam conditioning valve for depressurizing and desuperheating superheated steam by supplying moisture thereto;

a discharge pipe connected to a discharge end of the steam conditioning valve, the discharge pipe comprising:

a horizontal section being provided with a moisture drain in proximity to the bottom of the horizontal section, and a vertical section between the steam conditioning valve and the horizontal section;

a nozzle for injecting a water mist into a lower portion of the steam conditioning valve; and a conduit for connecting said nozzle to said drain for transporting condensed water to said nozzle.

2. The steam conditioning system of claim 1 wherein the nozzle has an opening exiting into an annular reduction in the longitudinal cross-section of the lower portion of said valve, wherein moisture is drawn from the discharge pipe drain through the transport conduit and out the nozzle exit into the conditioning valve due to Venturi effect in the annular reduction of the valve.

3. A steam pressure reducing and conditioning system operable to be connected between a steam source and a steam work section, the system comprising:

a valve having an inlet and an outlet, the inlet receiving superheated steam from the steam source;

a discharge pipe having a proximal end, a distal end, a vertical portion between the ends, and a horizontal portion between the vertical portion and the distal end, the proximal end being connected to the valve outlet and the distal end supplying steam to the steam work section; and a transport conduit connecting the horizontal portion of the discharge pipe to the valve.

4. The system of claim 3, wherein the valve comprises a reduced annular section and a nozzle disposed in the reduced annular section relative to the discharge pipe, whereby steam flowing through the reduced annular section will flow faster than steam through the discharge pipe, and wherein the transport conduit is connected to the nozzle of the valve, whereby moisture is drawn through the transport conduit from the horizontal portion of the discharge pipe into the valve due to the reduced annular section in the valve.

5. The system of claim 3, comprising a forced delivery apparatus connected to the transport conduit for delivering moisture to the valve from the horizontal portion of the discharge pipe.

6. A steam pressure reducing and conditioning system operable to be connected between a steam source and a steam work section, the system comprising:

a valve having an inlet and an outlet, the inlet receiving superheated steam from the steam source; and a discharge pipe having a proximal end, a distal end, a vertical portion between the ends, and a horizontal portion between the vertical portion and the distal end, wherein the proximal end is connected to the valve outlet, the distal end supplies steam to the steam work section and the horizontal portion comprises a drain.

7. The system of claim 6, wherein the horizontal portion comprises a bottom portion and the drain is positioned in the bottom portion.

8. The system of claim 6, comprising recycling means connecting the drain and the valve for transporting moisture from the horizontal portion of the discharge pipe to the valve.

9. The system of claim 6, comprising a transport conduit connecting the valve and the drain.

10. The system of claim 9, wherein the discharge pipe has a predetermined area through which steam flows and the valve has a reduced area, relative to the predetermined area of the discharge pipe, through which steam flows faster than through the predetermined area of the discharge pipe.

11. The system of claim 10, wherein the valve comprises one or more nozzles in the reduced area of the valve and the transport conduit is connected to the one or more nozzles, whereby moisture is drawn through the transport conduit from the drain to the one or more nozzles due to the reduced area of the valve.

12. A steam pressure reducing and conditioning system operable to be connected between a steam source and a steam work section, the system comprising:

a valve having an inlet and an outlet, the inlet receiving superheated steam from the steam source, the valve comprising:

an annular section having a diameter, and a nozzle in the annular section for injecting mist into the valve;

a discharge pipe having a proximal end connected to the valve outlet, a distal end supplying steam to the steam work section and a portion having a predetermined diameter between the ends, the diameter of the portion larger than the diameter of the annular section such that moisture is drawn from the discharge pipe to the nozzle due to the difference in diameters.

13. The system of claim 12, comprising:

a transport conduit connecting the portion of the discharge pipe with the nozzle.

14. The system of claim 13, wherein the discharge pipe comprises a vertical portion between the proximal end and the portion of the discharge pipe, and the portion of the discharge pipe is horizontal and comprises a drain to the transport conduit.

15. A method of operating a steam pressure reducing and conditioning system, the method comprising:

receiving in an inlet of a valve superheated steam;

cooling the superheated steam passing through the valve;

receiving moisture in a horizontal portion of a discharge pipe connected to the valve the discharge pipe comprising a vertical portion between the horizontal portion and the valve;

removing condensed moisture from the horizontal portion; and transporting the removed condensed moisture to the valve for cooling the superheated steam.

16. The method of claim 15, comprising supplying the removed condensed moisture to the superheated steam passing through the valve.

17. The method of claim 16, wherein supplying the removed condensed moisture to the superheated steam passing through the valve comprises injecting the removed condensed moisture into the valve.

18. The method of claim 17, wherein supplying the removed condensed moisture to the superheated steam passing through the valve comprises misting the superheated steam with the removed condensed moisture.

19. The method of claim 15, wherein removing the condensed moisture from the horizontal portion comprises creating a pressure differential between an area in the valve and an area in the discharge pipe, whereby the condensed moisture is drawn into the valve.

20. The method of claim 15, wherein removing the condensed moisture comprises draining the condensed moisture from the horizontal portion into a transport conduit connected to the valve.

* * * * *

UNITED STATES PATENT AND TRADEMARK OFFICE

CERTIFICATE OF CORRECTION

PATENT NO. : 6,758,232 B2
DATED : July 6, 2004
INVENTOR(S) : Hiroyuki Higuchi

Figure 3:
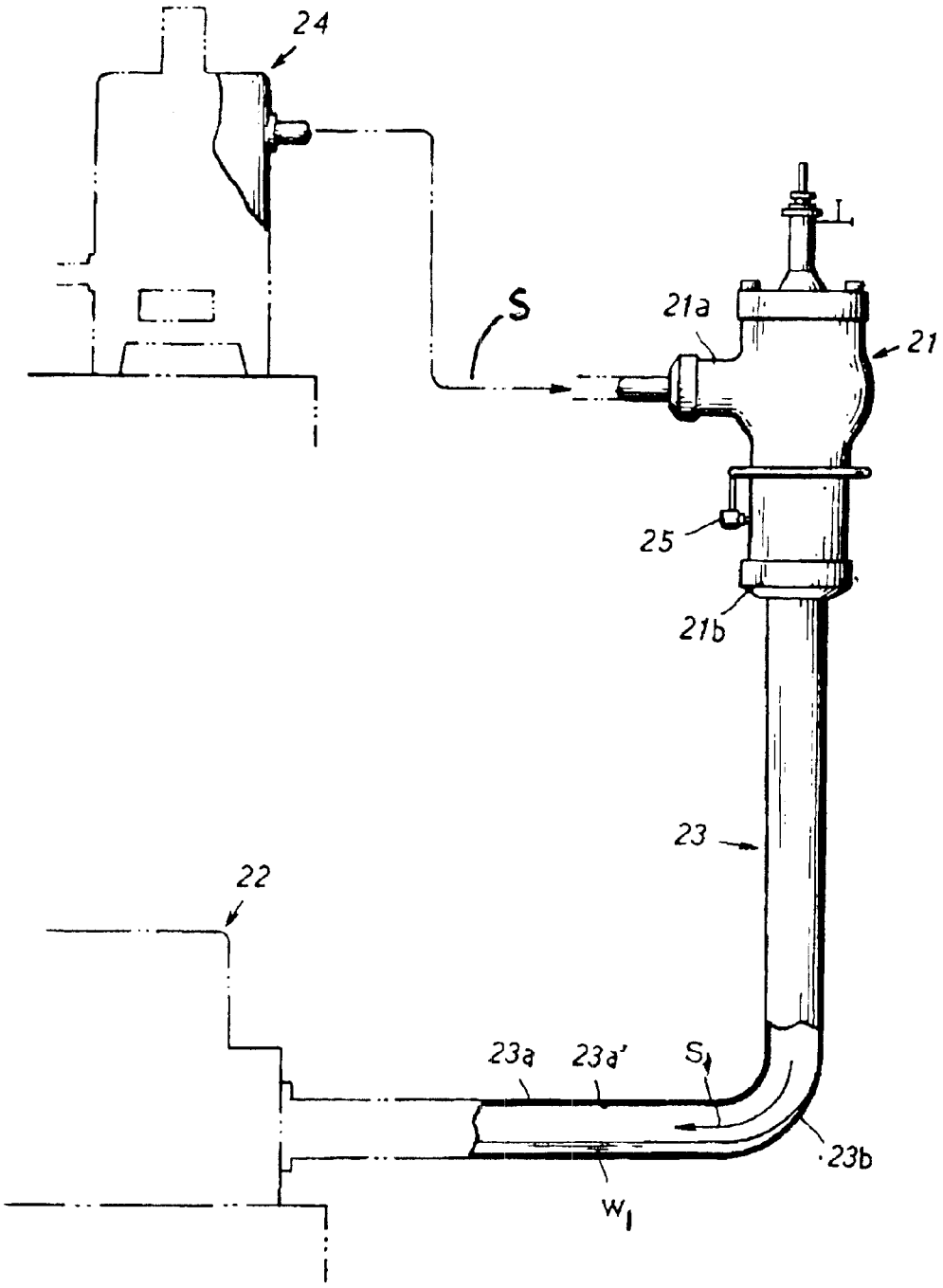
FIG. 3 is a partial side view with schematic elements illustrating the operation of a prior art steam pressure reducing and conditioning system.
Figure 1:
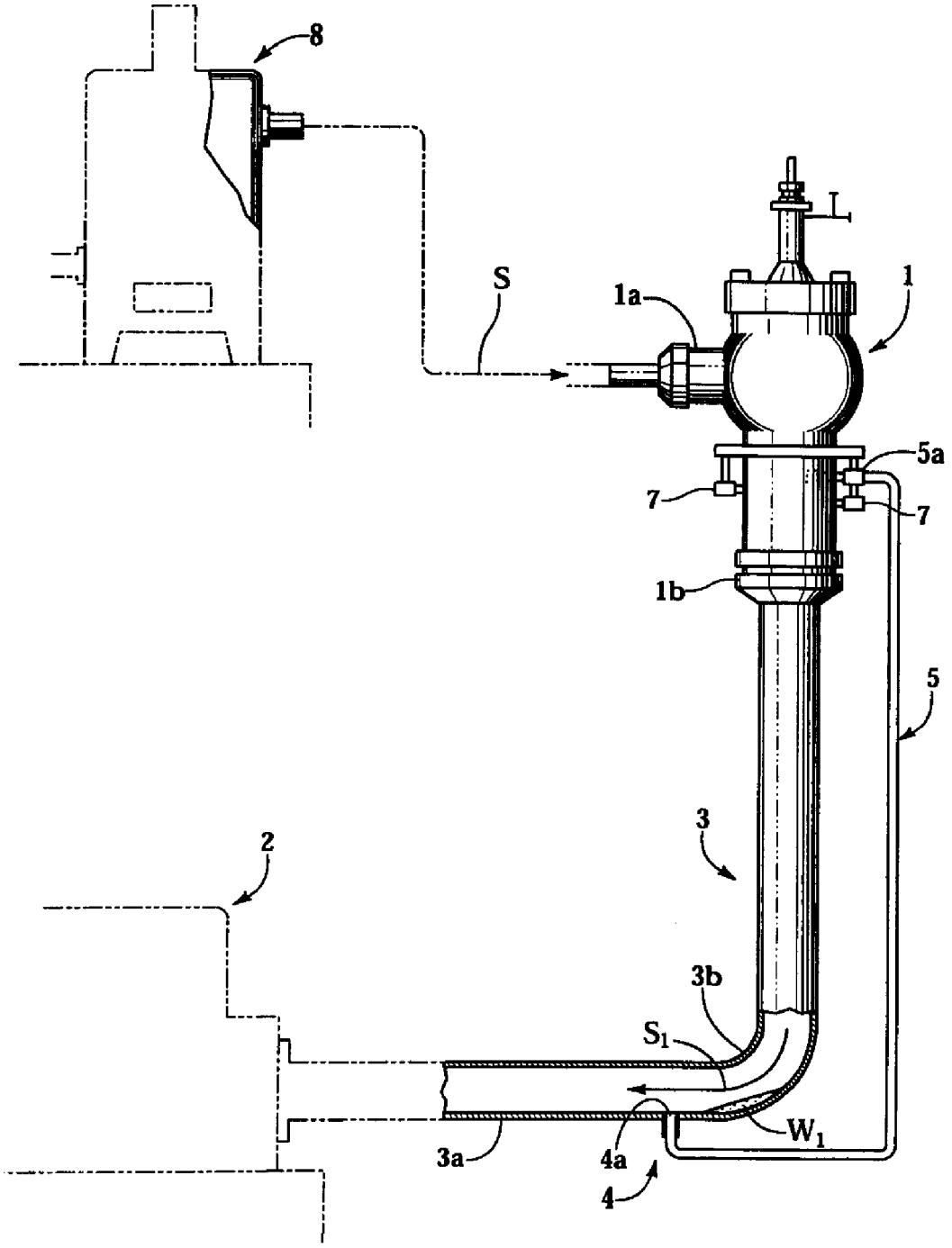
Figure 2:
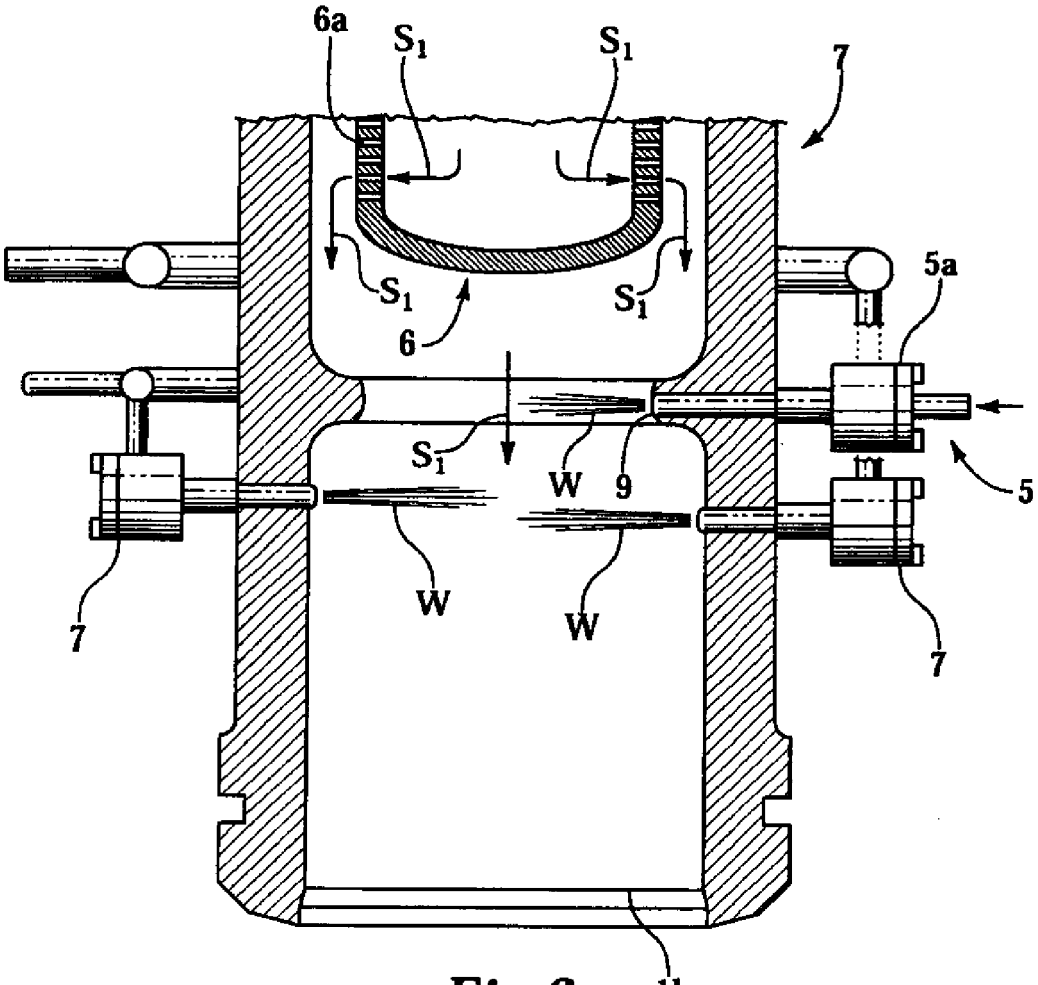
Figure 3:
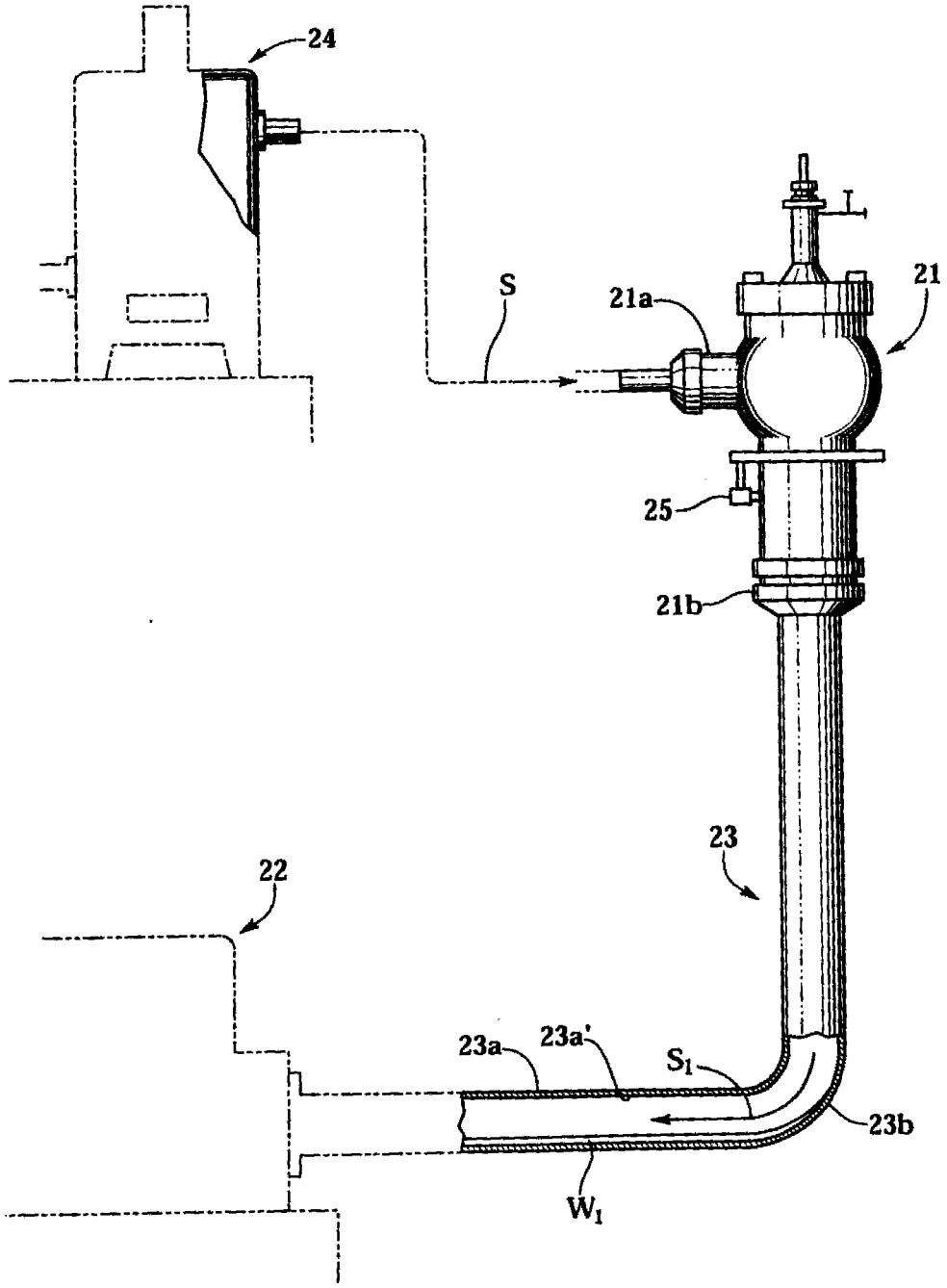
Fig.3 (PRIOR ART)
Figure 1:
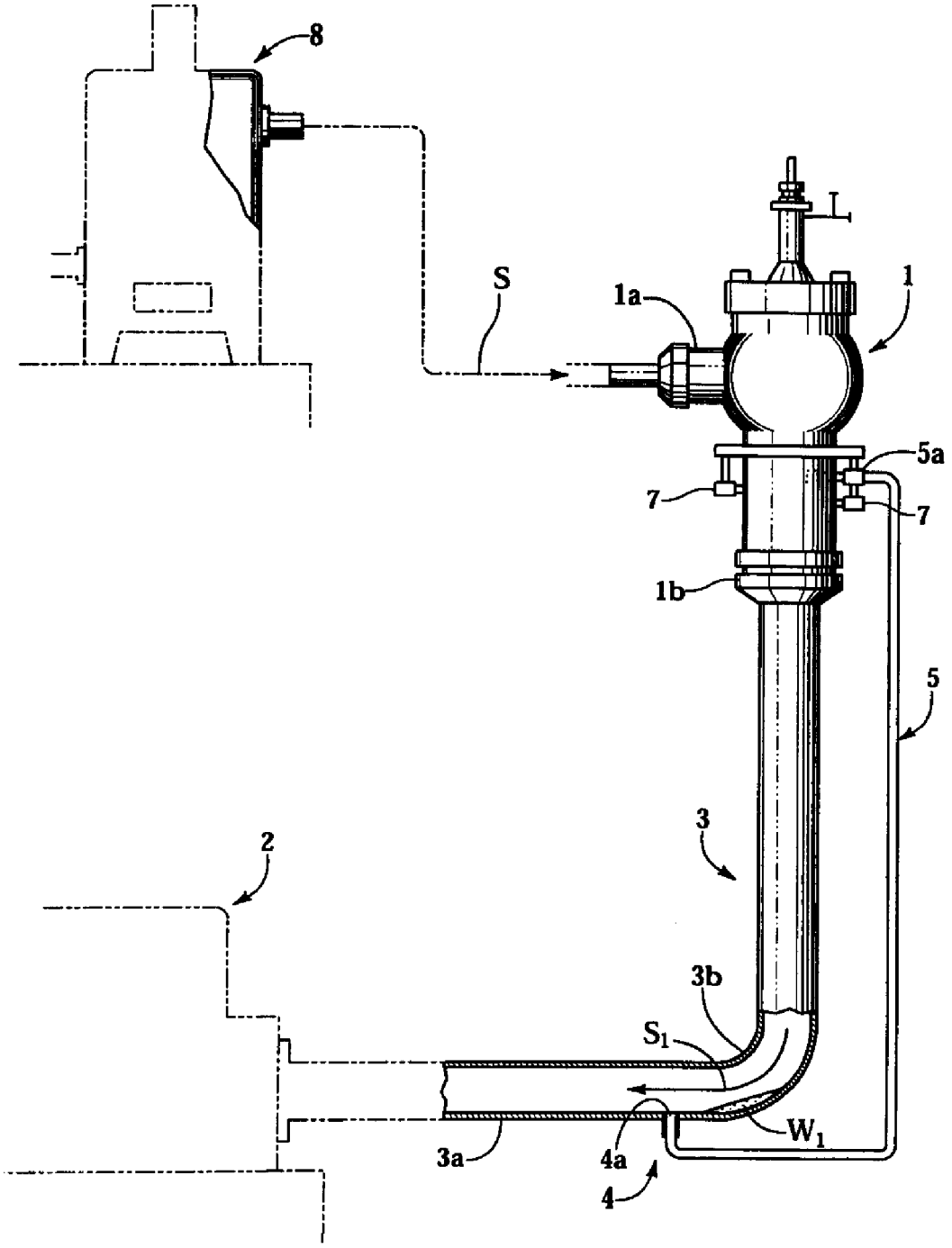
Figure 2:
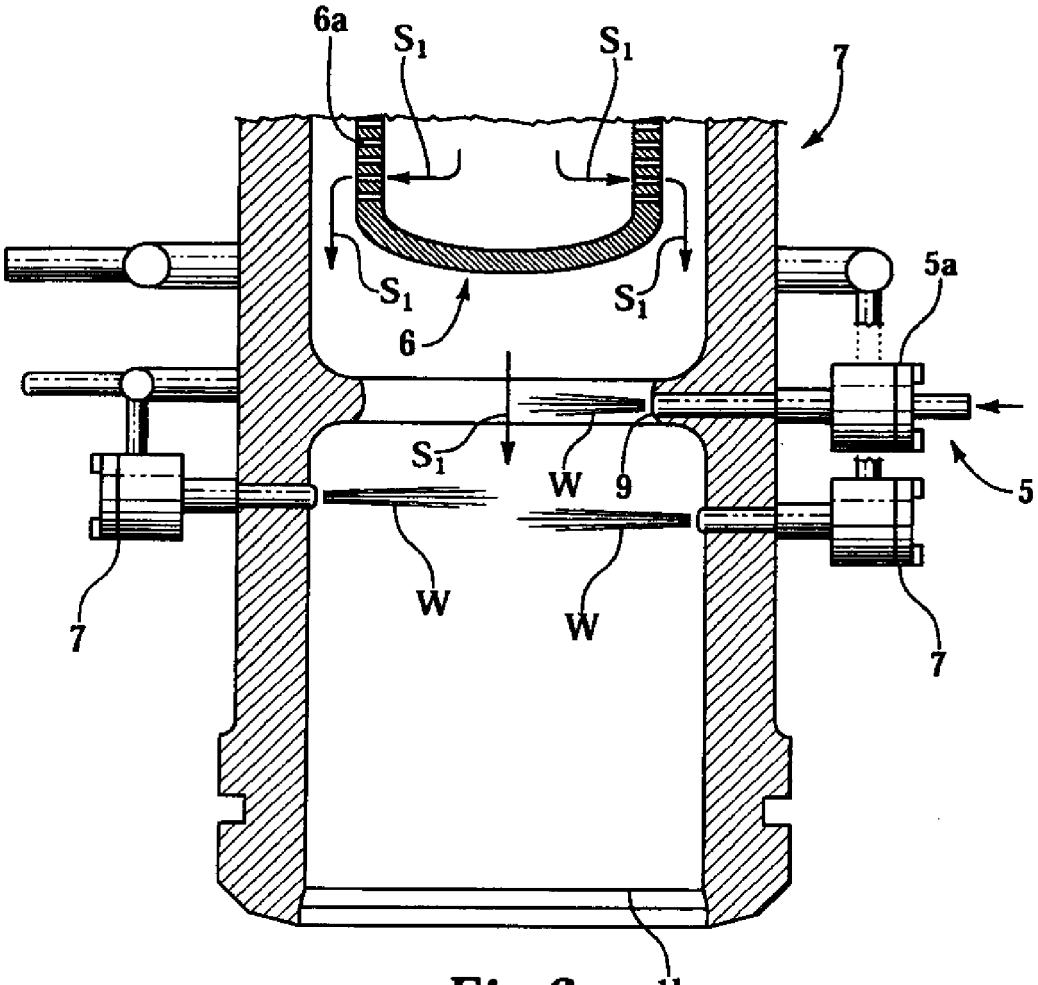
Figure 3:
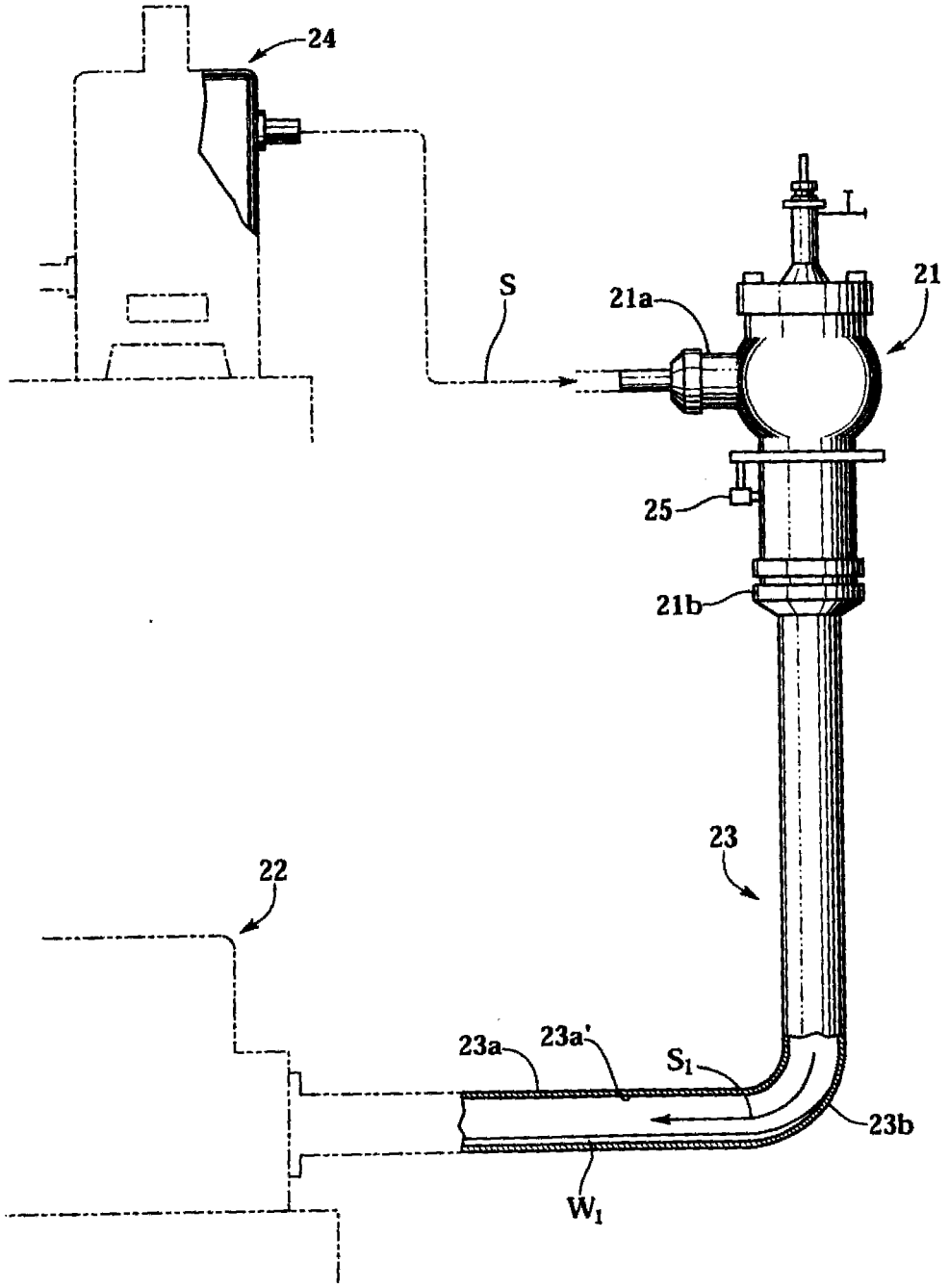
Fig.3 (PRIOR ART)

It is certified that error appears in the above-identified patent and that said Letters Patent is hereby corrected as shown below:

The title page should be deleted and substitute therefore the attached title page Replace drawing sheets 1-3 with new drawing sheets (Figs. 1-3), as shown on the attached pages Signed and Sealed this Eighth Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,758,232 B2
DATED : July 6, 2004
INVENTOR(S) : Hiroyuki Higuchi

It is certified that error appears in the above-identified patent and that said Letters Patent is hereby corrected as shown below:

The title page should be deleted and substitute therefore the attached title page Replace drawing sheets 1-3 with new drawing sheets (Figs. 1-3), as shown on the attached pages This certificate supersedes Certificate of Correction issued March 8, 2005.

Signed and Sealed this

Twenty-sixth Day of July, 2005

JON W. DUDAS
*Director of the United States Patent and Trademark Office*

(12) United States Patent
Higuchi

(10) Patent No.: US 6,758,232 B2
(45) Date of Patent: Jul. 6, 2004

(54) STEAM PRESSURE REDUCING AND CONDITIONING SYSTEM

(75) Inventor: Hiroyuki Higuchi, Kashiwazaki (JP)

(73) Assignee: Dresser, Inc., Addison, TX (US)

( * ) Notice: Subject to any disclaimer, the term of this patent is extended or adjusted under 35 U.S.C. 154(b) by 123 days.

(21) Appl. No.: 10/039,343

(22) Filed: Jan. 4, 2002

(65) Prior Publication Data

US 2002/0092483 A1 Jul. 18, 2002

(51) Int. Cl.[7] ..... B01D 47/00
(52) U.S. Cl. ..... 137/3; 137/605
(58) Field of Search ..... 137/605, 606, 137/607, 3

(56) References Cited

U.S. PATENT DOCUMENTS

| | | | | |
|---|---|---|---|---|
| 1,152,176 | A | 8/1915 | Hennebohle | |
| 1,307,986 | A | 6/1919 | Randall et al. | |
| 1,832,652 | A | 11/1931 | Peebles | |
| 2,095,263 | A | 10/1937 | Moss | 251/11 |
| 2,207,646 | A | 7/1940 | Van Der Ploeg | 122/459 |
| 2,354,842 | A | 8/1944 | Spence | 261/116 |
| 2,421,761 | A | 6/1947 | Rowand et al. | |
| 2,924,424 | A | 2/1960 | Titterington | 251/305 |
| 2,984,468 | A | 5/1961 | Kuhner | 261/79 |
| 3,034,771 | A | 5/1962 | Harris | 261/36 |
| 3,050,262 | A | 8/1962 | Curtis | 239/400 |
| 3,207,492 | A | 9/1965 | Zikesch | |
| 3,219,323 | A | 11/1965 | Spence | |
| 3,220,708 | A | 11/1965 | Matsui | 261/39 |
| 3,318,321 | A | 5/1967 | Odendahl | 137/117 |
| 3,331,590 | A | 7/1967 | Battenfeld et al. | 261/50 |
| 3,496,724 | A | 2/1970 | Wilson | 60/105 |
| 3,648,714 | A | 3/1972 | Laveau | 137/7 |
| 3,709,245 | A | 1/1973 | O'Connor, Jr. | 251/127 |
| 3,719,524 | A | 3/1973 | Ripley et al. | |
| 3,722,854 | A | 3/1973 | Parola | 251/127 |
| 3,732,851 | A | 5/1973 | Self | |
| 3,735,778 | A | 5/1973 | Garnier | 137/604 |
| 3,746,049 | A | 7/1973 | O'Connor, Jr. | 137/802 |
| 3,750,698 | A | 8/1973 | Walchle et al. | 137/375 |
| 3,776,278 | A | 12/1973 | Allen | 137/625.38 |
| 3,813,079 | A | 5/1974 | Baumann et al. | 251/127 |
| 3,856,049 | A | 12/1974 | Scull | 138/42 |

(List continued on next page.)

FOREIGN PATENT DOCUMENTS

| | | |
|---|---|---|
| DE | 37 17 128 A1 | 12/1988 |
| DE | 298 01 762 U1 | 4/1998 |
| FR | 595499 | 10/1925 |
| FR | 2082083 | 11/1971 |
| GB | 772058 | 4/1957 |
| GB | 2019532 | 10/1979 |
| JP | 61153082 | 7/1986 |
| WO | WO 91/00971 | 1/1991 |
| WO | WO 97 03313 | 1/1997 |

OTHER PUBLICATIONS

European Patent Office Search Report signed by Examiner Girbes Fontana, completed Sep. 8, 2003.

(List continued on next page.)

*Primary Examiner*—Stephen M. Hepperle
(74) *Attorney, Agent, or Firm*—Fish & Richardson P.C.

(57) ABSTRACT

A steam conditioning system including a steam conditioning valve 1 for depressurizing and desuperheating steam S by supplying moisture W in the conditioning valve. A discharge pipe 3 connected to the steam conditioning valve 1 has a horizontal section 3*a*, and the horizontal arrangement section 3*a* is provided with a moisture drain 4 or at a portion near the bottom. Condensed moisture $W_1$ is extracted from this moisture drain 4 and is recycled as moisture W to be supplied to the steam S in the conditioning valve 1. The steam conditioning valve 1 further has a reduced annular section 9 with a nozzle 5*a* disposed therein for injecting subcooled water mist W. A transport conduit 5 connects the drain 4 to nozzle 5*a*. Moisture W is drawn into steam flow S due to the Venturi effect caused by the pressure drop through the reduced annular section 9.

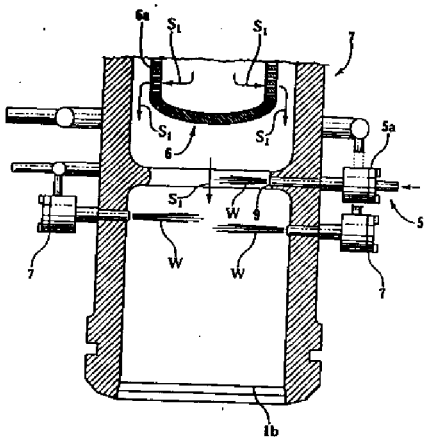

20 Claims, 3 Drawing Sheets